United States Patent [19]

Grufman

[11] 4,424,760

[45] Jan. 10, 1984

[54] HANGING CHAIR

[76] Inventor: Fredrik A. Grufman, Alvägen 61, S-182 45 Enebyberg, Sweden

[21] Appl. No.: 356,793

[22] Filed: Mar. 10, 1982

[30] Foreign Application Priority Data

Mar. 26, 1981 [SE] Sweden ..... 8101944

[51] Int. Cl.[3] ..... B63B 29/04

[52] U.S. Cl. ..... 114/363; 114/194; 297/273; 182/150

[58] Field of Search ..... 114/194, 363; 297/273, 297/274, 276, 277; 182/142, 150

[56] References Cited

U.S. PATENT DOCUMENTS

| | | | |
|---|---|---|---|
| 284,360 | 9/1883 | Bauer | 182/150 |
| 717,666 | 1/1903 | Fahldiek | 182/150 |
| 1,503,493 | 8/1924 | Eiffe | 297/276 |

*Primary Examiner*—Trygve M. Blix
*Assistant Examiner*—Rodney Corl
*Attorney, Agent, or Firm*—Gipple & Hale

[57] ABSTRACT

A hanging chair with seat (1) and backrest (2) is provided for its suspension with lifting slings (23,24) a top eye and crotch straps (25,26) at the seat (1). The slings and crotch straps are formed from a single hose of the type which dilates radially for axial compression and increases its inner diameter from a nominal value in an unloaded state and contracts the diameter for an axial pulling load. A portion of the hose forming the sling (24) is taken through a hole (10) in the seat (1) under the seat and up through a hole (9) therein to form the sling (23) and lifting eye, internally along the sling (23), out from it to the backrest (2), and after passing along the back of the latter, to the sling (24), up through an opening (21) in the latter and out. Another portion of the hose forms one crotch strap (25), and is taken under the seat and out to form the other crotch strap (26), continues inside the sling (23) up to and out through an opening (19) therein. The height of the lifting eye above the seat may consequently be adjusted by means of the hose portions without utilizing separate buckles.

1 Claim, 2 Drawing Figures

Fig. 2
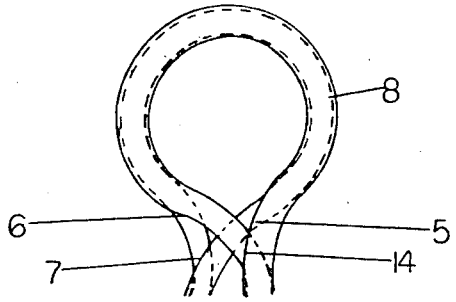
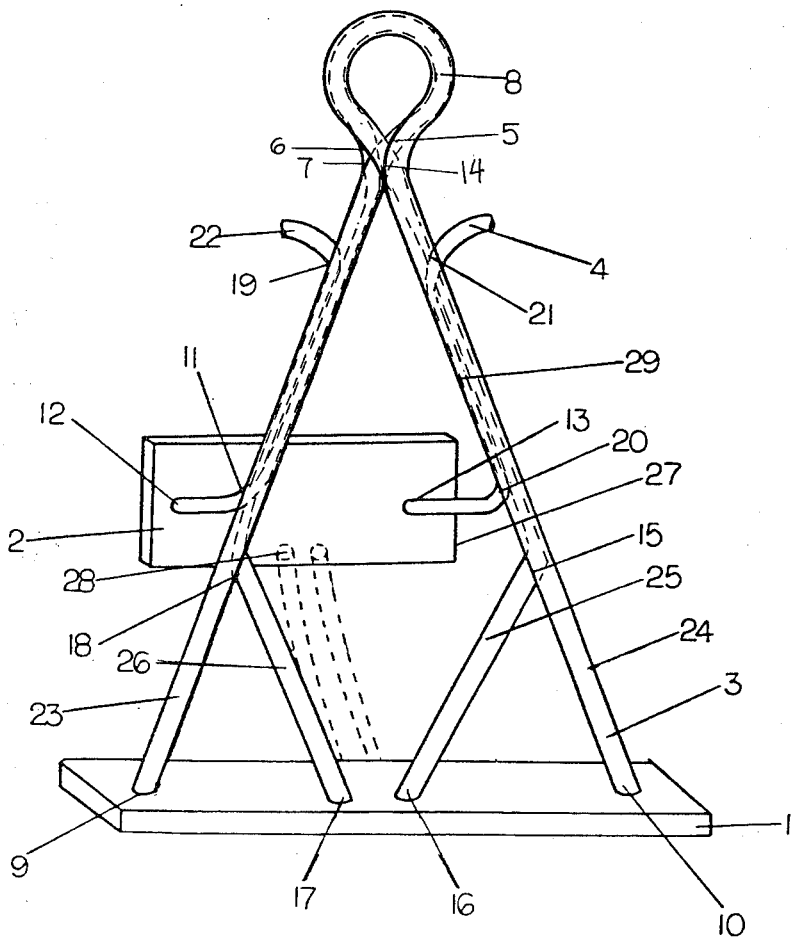
Fig. 1

HANGING CHAIR

The invention relates to a hanging chair (boatswain's chair) with seat. The backrest and crotch strap comprise seat and backrest, e.g. of wood, and a continuous hose of the type which expands radially for axial compression, and increases its internal diameter from a nominal value corresponding to an unloaded state, while for axial pull it is contracted radially and reduces its internal diameter to under the nominal value.

The object of the invention is to provide a chair of said type, which completely lacks separate buckles, although it may be adjusted within wide limits and is considerably cheaper than known chairs.

This object is completely achieved by the chair disclosed in the claims, and which is described below in conjunction with the appended drawing, where FIG. 1 is a sideview of a chair in accordance with the invention, and FIG. 2 depicts the uppermost portion of the chair in FIG. 1 to a larger scale.

On the drawing there is shown a boatswain's chair comprising a seat 1, and a backrest 2, e.g. of wood, and a continuous hose 3, which increases its interior diameter 29 over a nominal value corresponding to an unloaded state when compressed axially and substantially decreases said diameter when subjected to axial pull. The hose is preferably made from plaited yarn or plastic strip. Such hoses are commercially available.

The hose 3 has a first free end portion 4, which is first taken down through a hole 10 in the seat 1. The hose end 4 is then taken along the underside of the seat up to and through a hole 9. From here it is taken up to a hole 5 made in the hose at a height above the seat at least corresponding to the width thereof and so that the distance between opening 5 and hole 9 is the same as the distance between opening 5 and hole 10. The end 4 is further pulled a distance along the interior of the hose 5 and taken out through an opening 6. This distance is suitably proportioned in respect of the hose diameter so as to form the lifting eye of the chair. The hose end 4 is now taken through an opening 7 as close to the opening 6 as possible. The end 4 is then taken down through the interior of the hose to an opening 11 and out through it. The opening 11 is situated at approximately half the distance between opening 7 and hole 9. The end 4 is then taken through a hole 12 in the backrest 2 and along the back of it to and out through a hole 13. The other hose end 22, which is opened at 6, is taken in through an opening 14 in the hose at the same height as opening 7. The hose end 22 is pulled down through the interior of the hose to, and out through an opening 15, a distance below a height corresponding to that of opening 11. The end 22 then goes freely down to a hole 16 and through it, this hole 16 being at the front portion of the seat. On the underside of the seat the end 22 is pulled through the interior of the hose a distance of at least double its diameter. The end 22 is then taken up through a hole 17, situated as close to hole 16 as possible. The end 22 then goes freely up to and through an opening 18 at the same height as the opening 15. The hose end 22 is then pulled up through the interior of the hose to and out through an opening situated a distance under the lifting eye 8. The hose end 4 is taken to and through an opening 20, at the same height as the opening 11, further up through the hose interior to and out through an opening 21 at the same height as opening 19.

When a plaited hose is used said openings are provided by parting the yarn or strips to form the respective opening.

The crotch straps formed by the hose are adjusted to the person seated, either by the end portion 22 being pulled out of the opening 19, when the chair is only lightly loaded, or by the crotch strap 26 being pulled out of the opening 18 under light load. The position of the backrest is adjusted in a similar way to the sitting person, with the aid of the end 4 or the hose portion between the opening 20 and hole 13.

If so desired, further safety may be obtained by the end 22 being taken from the hole 16, under the seat, up to and through hole 27 in the backrest, along the back of which end 22 is taken to, and through hole 17 to continue as before.

It has been assumed above that a boatswain's chair has both crotch straps and backrest, but either one may be dispensed with. For crotch straps only the end 4 stops at a point corresponding to the opening 11. For a backrest only the end 22 stops at a point corresponding to opening 15.

In operation the hose is subjected to pulling forces resulting in that the hose portions between 8 and 15, as well as between 8 and 18 contract heavily round the hose portions in the interior thereof, thus obtaining a secure lock.

I claim:

1. A hanging chair (boatswain's chair) with backrest and crotch straps, comprising a seat and backrest, e.g. of wood and a continuous hose of the type which expands radially for axial compression, and increases its internal diameter from a nominal value corresponding to an unloaded state, while for axial pull it is contracted radially and reduces its internal diameter to under the nominal value, characterized in that one end portion of hose is taken down through a first side seat hole in the seat, along the underside of the seat up to and through a second side seat hole in the seat, freely up to a first lifting eye opening made in the hose at a height above the seat at least corresponding to the width thereof, further pulled a distance along the interior of the hose and taken out through a second lifting eye opening and into a first sling opening to form first and second lifting slings and lifting eye of the chair, and on the inside of the second lifting sling to and out through a first backrest opening approximately at the middle of the sling, the one end portion being further taken through a first hole in the backrest, along the back of it and out through a second hole in the backrest, in that the other end portion of the hose is taken through a second sling opening at the lifting eye, along the inside of the first lifting sling to and through a first strap opening below the middle of the first lifting sling down to and through a first central hole in the seat, along the inside of the hose between said first and second side seat holes in the seat outer edges for a length of at least twice the hose diameter, up through a second central hole in the seat to and through a second strap opening on the second lifting sling at the same height as the first strap opening on the first lifting sling and thus forming seat crotch straps, said other end portion follows the interior of the hose as far as, and out through a strap adjustment opening under the lifting eye and forming an adjusting strap for the crotch straps, and in that the first end portion is taken through a second backrest opening of the second lifting sling at the same height as that of the first backrest opening, along the interior of the hose and out through a backrest adjustment opening at the same height as the strap adjustment opening to form a backrest with adjustment facility.

* * * * *